US007565808B2

(12) United States Patent
Sullivan

(10) Patent No.: US 7,565,808 B2
(45) Date of Patent: Jul. 28, 2009

(54) REFRIGERATOR

(75) Inventor: Shaun Sullivan, Salem, OR (US)

(73) Assignee: GreenCentAire, LLC, Eden Prairie, MN (US)

( * ) Notice: Subject to any disclaimer, the term of this patent is extended or adjusted under 35 U.S.C. 154(b) by 555 days.

(21) Appl. No.: 11/198,617

(22) Filed: Aug. 5, 2005

(65) Prior Publication Data

US 2006/0150643 A1 Jul. 13, 2006

Related U.S. Application Data

(60) Provisional application No. 60/644,220, filed on Jan. 13, 2005.

(51) Int. Cl.
*F25B 9/02* (2006.01)

(52) U.S. Cl. ..... 62/5

(58) Field of Classification Search ..... 62/5
See application file for complete search history.

(56) References Cited

U.S. PATENT DOCUMENTS

| | | | | |
|---|---|---|---|---|
| 1,952,281 | A * | 3/1934 | Ranque | 62/5 |
| D184,490 | S | 2/1959 | Petrie | |
| 2,920,457 | A | 1/1960 | Bartlett, Jr. | |
| D191,304 | S | 9/1961 | Lind | |
| 3,074,243 | A | 1/1963 | Tilden | |
| 3,103,104 | A | 9/1963 | Shackson | |
| 3,173,273 | A | 3/1965 | Fulton | |
| 3,208,229 | A | 9/1965 | Fulton | |
| 3,277,238 | A | 10/1966 | Sharp | |
| D208,405 | S | 8/1967 | Dixon | |
| 3,461,676 | A | 8/1969 | Toelke | |
| D216,886 | S | 3/1970 | Myers | |
| 3,522,710 | A * | 8/1970 | Merkulov et al. | 62/5 |
| 3,630,040 | A | 12/1971 | Goldfarb | |
| 3,654,768 | A | 4/1972 | Inglis | |
| 3,786,643 | A | 1/1974 | Anderson et al. | |
| D233,039 | S | 10/1974 | Dixon | |

(Continued)

FOREIGN PATENT DOCUMENTS

| | | |
|---|---|---|
| EP | 0676599 | 10/1995 |

(Continued)

OTHER PUBLICATIONS

He Shu et al, "Effect of Nozzles on Energy Separation Performance of Vortex Tube," Journal of Chemical Industry and Engineering (China), vol. 56, No. 11, Nov. 2005.

(Continued)

*Primary Examiner*—William C Doerrler
(74) *Attorney, Agent, or Firm*—Fredrikson & Byron, PA

(57) ABSTRACT

A refrigerator includes a gas flow generator formed with passages providing communication between an annular inlet chamber and a gas flow chamber, so that gas under pressure in the inlet chamber flows through the passages into the gas flow chamber. An energy transfer tube has a cylindrical interior space in communication with the gas flow chamber at one end of the tube and a throttle valve is installed in the energy transfer tube at its opposite end. An acoustic tone at a frequency in the range between about 1 kHz and about 20 kHz is spontaneously generated in the energy transfer tube when gas at a pressure exceeding about 100 psig is supplied to the inlet chamber.

30 Claims, 5 Drawing Sheets

U.S. PATENT DOCUMENTS

| | | | | |
|---|---|---|---|---|
| 3,969,908 | A | | 7/1976 | Lawless |
| 3,982,378 | A | * | 9/1976 | Sohre ..... 60/650 |
| 4,022,599 | A | | 5/1977 | Wilson et al. |
| 4,240,261 | A | | 12/1980 | Inglis |
| D257,787 | S | | 1/1981 | Armbruster |
| 4,305,339 | A | | 12/1981 | Inglis |
| 4,333,754 | A | | 6/1982 | Peter |
| D296,466 | S | | 6/1988 | Gratton |
| D298,453 | S | | 11/1988 | Gratton |
| 5,010,736 | A | | 4/1991 | York |
| 5,533,354 | A | | 7/1996 | Pirkle |
| 5,561,982 | A | | 10/1996 | Tunkel |
| 5,623,829 | A | | 4/1997 | Nutter et al. |
| 5,685,475 | A | | 11/1997 | Jairazbhoy |
| D401,313 | S | | 11/1998 | Murakami |
| 5,911,740 | A | | 6/1999 | Tunkel et al. |
| 5,937,654 | A | | 8/1999 | Tunkel |
| D415,564 | S | | 10/1999 | Sendo |
| 5,966,942 | A | | 10/1999 | Mitchell |
| D428,978 | S | | 8/2000 | Ito et al. |
| 6,109,041 | A | | 8/2000 | Mitchell et al. |
| 6,119,477 | A | | 9/2000 | Chan |
| 6,158,237 | A | | 12/2000 | Riffat |
| 6,289,679 | B1 | | 9/2001 | Tunkel |
| 6,305,183 | B1 | | 10/2001 | Mukai |
| 6,355,129 | B1 | | 3/2002 | Paulus |
| 6,398,851 | B1 | | 6/2002 | Bose |
| 6,401,463 | B1 | | 6/2002 | Dukhan et al. |
| 6,402,047 | B1 | | 6/2002 | Thomas |
| 6,425,249 | B1 | | 7/2002 | Cho |
| 6,434,968 | B2 | | 8/2002 | Buchholz |
| 6,442,947 | B1 | | 9/2002 | Mitchell |
| 6,574,968 | B1 | | 6/2003 | Symko et al. |
| 6,804,967 | B2 | | 10/2004 | Symko et al. |
| 6,990,817 | B1 | | 1/2006 | Bhatia |
| 2001/0002588 | A1 | | 6/2001 | Salber |
| 2001/0003702 | A1 | | 6/2001 | Livchak et al. |
| 2001/0016172 | A1 | | 8/2001 | Fukuoka |
| 2001/0020366 | A1 | | 9/2001 | Cho |
| 2001/0025478 | A1 | | 10/2001 | Fineblum |
| 2001/0027857 | A1 | | 10/2001 | Emrich |
| 2001/0031393 | A1 | | 10/2001 | Oda |
| 2001/0032477 | A1 | | 10/2001 | Schlom |
| 2001/0040062 | A1 | | 11/2001 | Illingworth |
| 2001/0041136 | A1 | | 11/2001 | Fujinaka |
| 2001/0042380 | A1 | | 11/2001 | Cho |
| 2001/0048877 | A1 | | 12/2001 | Illingworth |
| 2001/0048900 | A1 | | 12/2001 | Bardell |
| 2001/0052411 | A1 | | 12/2001 | Pantow |
| 2002/0007645 | A1 | | 1/2002 | Jeuch |
| 2002/0007853 | A1 | | 1/2002 | Fazekas |
| 2002/0009364 | A1 | | 1/2002 | Otsuka |
| 2002/0025864 | A1 | | 2/2002 | Barfield |
| 2002/0046830 | A1 | | 4/2002 | Ulrich |
| 2002/0051719 | A1 | | 5/2002 | Shiibayashi |
| 2002/0056281 | A1 | | 5/2002 | Bieberich |
| 2002/0062650 | A1 | | 5/2002 | Dukhan et al. |
| 2002/0064739 | A1 | | 5/2002 | Boneberg |
| 2002/0066278 | A1 | | 6/2002 | Cho |
| 2002/0068847 | A1 | | 6/2002 | Riach, Jr. |
| 2002/0073848 | A1 | | 6/2002 | Cho |
| 2002/0074105 | A1 | | 6/2002 | Hayashi |
| 2002/0074870 | A1 | | 6/2002 | Vandervort |
| 2002/0074874 | A1 | | 6/2002 | Tong |
| 2002/0075171 | A1 | | 6/2002 | Kuntman |
| 2002/0076323 | A1 | | 6/2002 | Fujinaka |
| 2002/0076327 | A1 | | 6/2002 | Houten |
| 2002/0079058 | A1 | | 6/2002 | Okumura |
| 2002/0080680 | A1 | | 6/2002 | Proper |
| 2002/0081468 | A1 | | 6/2002 | Shioya |
| 2002/0085448 | A1 | | 7/2002 | Phillips |
| 2002/0088273 | A1 | | 7/2002 | Harness |
| 2002/0090295 | A1 | | 7/2002 | Torii |
| 2002/0092119 | A1 | | 7/2002 | Vystrcil |
| 2002/0092449 | A1 | | 7/2002 | Gutmark |
| 2002/0092565 | A1 | | 7/2002 | Muramatsu |
| 2002/0093128 | A1 | | 7/2002 | Koffron |
| 2002/0094270 | A1 | | 7/2002 | Ito |
| 2002/0095741 | A1 | | 7/2002 | Inoue |
| 2002/0096471 | A1 | | 7/2002 | Miller, III |
| 2002/0100582 | A1 | | 8/2002 | Oldenburg |
| 2002/0102181 | A1 | | 8/2002 | Salbilla |
| 2002/0105190 | A1 | | 8/2002 | Thomas |
| 2002/0106275 | A1 | | 8/2002 | Harvey |
| 2002/0109518 | A1 | | 8/2002 | Saito |
| 2002/0110469 | A1 | | 8/2002 | Fukuoka |
| 2002/0110500 | A1 | | 8/2002 | Moore |
| 2002/0110735 | A1 | | 8/2002 | Farnham |
| 2002/0110814 | A1 | | 8/2002 | Remacle |
| 2002/0110899 | A1 | | 8/2002 | Wheatcroft |
| 2003/0192324 | A1 | | 10/2003 | Smith et al. |
| 2004/0000150 | A1 | | 1/2004 | Symko et al. |
| 2004/0216468 | A1 | | 11/2004 | Hatcher |
| 2004/0231341 | A1 | | 11/2004 | Smith |
| 2005/0000233 | A1 | | 1/2005 | Hao et al. |

FOREIGN PATENT DOCUMENTS

| | | |
|---|---|---|
| EP | 0684433 | 11/1995 |
| JP | 62-196561 | 8/1987 |
| RU | 2079067 | 5/1997 |
| SU | 377590 | 8/1973 |
| SU | 1135974 | 1/1985 |
| SU | SU1139939 | 2/1985 |
| SU | 1208430 | 1/1986 |

OTHER PUBLICATIONS

M. Kurosaka, "Acoustic Streaming in Swirling Flow and the Ranque-Hilsch (Vortex-Tube) Effect," Journal of Fluid Mechanics, vol. 124, Cambridge University Press, Cambridge, Nov. 1982, pp. 137-172.

A. Williams, "The Cooling of Methane with Vortex Tubes," The Journal of Mechanical Engineering Science, vol. 13, No. 6, Institution of Mechanical Engineers, Dec. 1971, pp. 369-378.

Byoung-Gook Loh et al, "Acoustic Streaming Induced by Ultrasonic Flexural Vibrations and Associated Enhancement of Convective Heat Transfer," Acoustical Society of America, vol. 111, No. 2, Feb. 2002, pp. 875-883.

Tetsushi Biwa, "New Acoustic Devices Based on Thermoacoustic Energy Conversion," JSME TED Newsletter, No. 41, 2003.

Kluge, "Die Stellung des Wirbelrohrs in der Reihe der Kalfgasmaschinen", Luft und Kaltetechnik 1970, pp. 139-143, with English-language abstract.

P. Kittel, "A Short History of Pulse Tube Refrigerators" website: http://irtek.arc.nasa.gov/CryoPTHist.html, Mar. 3, 2005.

M. Kurosaka et al., "Acoustic Streaming Induced by the "Vortex Whistle" is the Cause of the Ranque-Hilsch Effect", "Session G. Physical Acoustics I: Timely Topics" 104th Meeting: Acoustical Society of America, J. Acoust. Soc. Am. Suppl. 1, vol. 72, Fall 1982, pp. S12-S13.

N. Pimental et al., "Effectiveness of a Vortex Tube Microclimate Cooling System" Aviation, Space and Environmental Medicine, vol. 58, No. 5, May 1987, p. 495.

Kluge, "Die Stellung des Wirbelrohrs in der Reihe der Kalfgasmaschinen", Luft und Kaltetechnik 1970, pp. 139-143.

"EXAIR® Selecting the Right Vortex Tube" website: http://www.exair.com/vortextube/vt_selecting.htm, Mar. 3, 2005.

A. Crocker et al., "Investigation of Enhanced Vortex Tube Air Separators for Advanced Space Transportation", 40th Joint Propulsion Conference & Exhibit, Ft. Lauderdale, FL, Jul. 11-14, 2004, pp. 1-11.

W.F. Lienhard, et al., "Man Cooling by a Vortex Tube Device", Environmental Health, American Medical Association Publication, vol. 9, Jul.-Dec. 1964, pp. 377-386.

Y. Soni et al., "Optimal Design of the Ranque-Hilsch Vortex Tube", Transactions of the ASME, The American Soc. of Mechanical Engineers, vol. 97, No. 2, May 1975, pp. 316-317.
M. Kurosaka et al., "Ranque-Hilsch Effect Revisited: Temperature Separation Traced to Orderly Spinning Waves or Vortex Whistle", AIAA/ASME 3rd Joint Thermophysics, Fluids, Plasma and Heat Transfer Conference, Jun. 7-11, 1982, pp. 1-13.
"Vortex Tube Refrigeration", Refrigeration and Air Conditioning, vol. 75, No. 893, Aug. 1972, pp. 49-50.
J. Wheatley et al., "The Natural Heat Engine", Los Alamos Science, Fall 1986, pp. 2-32.
B.K. Ahlborn et al., "The Vortex Tube as a Classic Thermodynamic Refrigeration Cycle," J. App. Physics. vol. 88, No. 6, Sep. 15, 2000, pp. 3645-3653.
R. Aronson, "The Vortex Tube: Cooling with Compressed Air", Machine Design, vol. 48, No. 28, Dec. 9, 1976, pp. 140-143.
Y. Cao et al., "Thermodynamics Prediction of the Vortex Tube Applied to a Mixed-Refrigerant Auto-Cascade J-T Cycle", Proceedings of the 12th International Cryocooler Conference Held Jun. 18-20, 2002, Cryocoolers 12, pp. 621-626.
Y. Lee et al., "Vortex Tube Air Separation Applications for Air Collection Cycle Hypersonic Vehicles", 41st Aerospace Sciences Meeting and Exhibit Jan. 9, 2003, Reno, NV, pp. 1-11.
R. Boggs, "Vortex Tube Cools from Both Ends", Design News, Mar. 17, 1969, p. 58.
J. Lewins et al, "Vortex Tube Optimization Theory", Energy 24 (1999), pp. 931-943.
K. Kurosaka, "Vortex Whistle: An Unsteady Phenomenon in Swirling Flow Field", AIAA 19th Aerospace Sciences Meeting, Jan. 12-15, 1981, pp. 1-9.
Written Opinion and International Search Report, dated Aug. 3, 2007 for corresponding PCT Application No. PCT/US2006/000171 (5 pages).
Novelty Search Report from the Swedish Patent and Registration Office, dated Jun. 13, 2007 for corresponding PCT Application No. PCT/US2006/000171 (6 pages).
U.S. Appl. No. 60/407,200, filed Aug. 28, 2002.
U.S. Appl. No. 60/527,239, filed Dec. 5, 2003.
B.K. Ahlborn et al., "The Heat Pump in a Vortex Tube," J. Non-Equilib. Thermodyn. vol. 23, No. 2, 1998, pp. 159-165.
B. Ahlborn et al., "Secondary flow in a vortex tube," Fluid Dynamics Research. vol. 21, 1997, pp. 73-86.
B. Ahlborn et al., "Limits of temperature separation in a vortex tube," J. Phys. D: Appl. Phys. 27, 1994, pp. 480-488.
U. Behera et al., "CFD analysis and experimental investigations towards optimizing the parameters of Ranque-Hilsch vortex tube," International Journal of Heat and Mass Transfer: 48, 2005, pp. 1961-1972.
T. Blatt et al., "An Experimental Investigation of an Improved Vortex Cooling Device," Am. Soc. Mech. Eng., 1963, pp. 1-8.
H.H. Bruun, "Experimental Investigation of the Energy Separation in Vortex Tubes," The Journal of Mechanical Engineering Science, vol. 11, No. 6, Dec. 1969, pp. 567-582.
Deissler et al., "Analysis of the Flow and Energy Separation in a Turbulent Vortex," International Journal of Heat and Mass Transfer, vol. 1, 1960, pp. 173-191.
W. Fröhlingsdorf et al., "Numerical investigations of the compressible flow and the energy separation in the Ranque-Hilsch vortex tube," International Journal of Heat and Mass Transfer: 428, 1999, pp. 415-422.
C. Fulton, "Ranque's Tube," Refrigerating Engineering, vol. 58, No. 5, May 1950, pp. 473-479.
G. Goglia et al., "Experimental and Analytical Studies in Fluids," Old Dominion University Research Foundation, Sep. 1984, pp. 1-95.
D. Guillaume et al., "Demonstrating the achievement of lower temperatures with two-stage vortex tubes," Review of Scientific Instruments, vol. 72, No. 8, Aug. 2001, pp. 3446-3448.
A. Gutsol, "The Ranque effect," Physics—USPEKHI, vol. 40, No. 6, 1997, pp. 639-658.
R. Hilsch, "The Use of the Expansion of Gases in a Centrifugal Field as Cooling Process," The Review of Scientific Instruments, vol. 18, No. 2, Feb. 1947, pp. 108-113.
F.C. Hooper et al., "Pressure Effects on Bubble Growth in the Flashing of Superheated Water," Proceedings of Fourth International Heat Transfer Conference—Paris-Versailles, vol. V, 1970, pp. 1-11.
F.C. Hooper, "An Improved Expansion Process for the Vapour Refrigeration Cycle," Proceedings of Fourth Canadian Congress of Applied Mechanics, May 28-Jun. 1, 1973, pp. 811-812.
F.C. Hooper, "An Electric Dew Point Meter Cooled by the Vortex Tube," Refrigerating Engineering, vol. 60, No. 11, Nov. 1952, pp. 1196-1197.
S. Lin, "A Heat Transfer Relation for Swirl Flow in a Vortex Tube," The Canadian J. of Chem Eng., vol. 68, No. 6, Dec. 1990, pp. 944-947.
V.S. Martynovskii et al., "Investigation of the Vortex Thermal Separation Effect for Gases and Vapors," Soviet Physics—Technical Physics, vol 1, No. 10, 1957, pp. 2233-2242.
S. Piralishvili et al., "Flow and Thermodynamic Characteristics of Energy Separation in a Double-Circuit Vortex Tube—An Experimental Investigation," Experimental Thermal and Fluid Science, vol. 12, No. 4, May 1996, pp. 399-410.
P. Promvonge et al., "Experimental Investigation of Temperature Separation in a Vortex Tube Refrigerator With Snail Entrance," AJSTD, vol. 21, Issue 4, 2004, pp. 297-307.
P. Promvonge et al., "Investigation on the Vortex Thermal Separation in a Vortex Tube Refrigerator," SCIENCEASIA 31, 2005, pp. 215-223.
P. Promvonge et al., "Numerical Simulation of Turbulent Compressible Vortex-Tube Flow," 3rd ASME/JSME Joint Fluids Engineering Conference, Jul. 18-23, 1999, pp. 1-8.
M.H. Saidi et al., "Experimental modeling of vortex tube refrigerator," Applied Thermal Engineering:23, 2003, pp. 1971-1980.
G. Scheper, "The Vortex Tube—Internal Flow Data and A Heat Transfer Theory," Refrigerating Engineering, vol. 59, No. 10, Oct. 1951, pp. 985-1018.
D. Scott et al., "The Use of a Vortex Flow Tube in Refrigeration Evaporators," The Institute of Refrigeration, vol. 60, 1963-64, pp. 159-170.
He Shu et al., "Experimental study on the effect of the inlet pressure on the performance of vortex tube," ACTA Aerodynamica Sinica (China), vol. 24, No. 4, Dec. 2006, Abstract.
M. Sibulkin, "Unsteady, viscous, circular flow—Part 3. Application to the Ranque-Hilsch vortex tube," J. Fluid Mechanics, vol. 12, Part 2, Feb. 1962, pp. 269-293.
K. Stephan et al., "An Investigation of Energy Separation in a Vortex Tube," International Journal of Heat and Mass Transfer, vol. 26, No. 3, Mar. 1983, pp. 341-348.
H. Takahama, "Studies on Vortex Tubes," Japan Society of Mechanical Engineers, vol. 8, No. 31, 1965, pp. 433-440.
H. Takahama et al., "Performance Characteristics of Energy Separation in a Steam-Operated Vortex Tube," International Journal of Engineering Science, vol. 17, No. 6, 1979, pp. 735-744.
H. Takahama et al., "Energy Separation in Vortex Tubes with a Divergent Chamber," Am. Soc. Mech. Eng., vol. 103, May 1981, pp. 196-203.
B. Vonnegut, "A Vortex Whistle," The Journal of the Acoustical Society of America, vol. 26, Nos. 1-6, 1954, pp. 18-20.
H. Zhongyue et al., "Vortex tube and flow-rate characteristics," J. Dalian Univ. of Technology, 1994, abstract.
S. Zhou et al., "Inlet pressure and the flow rate of air-conditioning control cold eddy performance study," App. Science Foundation and Eng. J., 2006, 3 pages.
http://en.wikipedia.org/wiki/Thermoacoustic_hot_air_engine, May 9, 2008, 4 pages.
Steven L. Garrett, Scott Backhaus, "The Power of Sound", American Scientist, vol. 88, No. 6, Nov.-Dec. 2000, pp. 516-525.
L. Khodorkov, N.V. Poshernev, and M.A. Zhidkov, "The vortex-tube—a universal device for heating, cooling, cleaning, and drying gases and separating gas mixture." Chemical and Petroleum Engineering, 39(7-8):409-415, Jul. 2003.
Yenus A. Cengel and Robert H. Turner, "Fundaments of Thermal-Fluid Sciences—2nd Edition" McGraw-Hill 2005, Chapter 14, pp. 605-659.

A.I. Azarov, "Trends In Improvement In Serial Swirl Tubes", Khimicheskoe Neftegazovoe Mashinostroenie, 2004 vol. 7, pp. 24-27 (Includes English-language abstract).
Database WPI Week 198606 Thomson Scientific, London, GB; AN 1986-040640 XP002498287 - SU1139939 (Kazan Chem-Photo) Feb. 15, 1985, 5 pages (including English-language abstract).
Database WPI Week 199747 Thomson Scientific, London, GB; AN 1977-511144 XP002498289 - RU2079067 (Churkin RK) May 10, 1997, 7 pages (including English-language abstract).
English-language translation of SU377590 (Moscow Bauman Tech School) Aug. 2, 1973, 1 page.
English-language translation of SU1135974 (Odessa Refrig Ind Res) Jan. 23, 1985, 3 pages.
English-language translation of SU1208430 (Moscow Bauman Tech School) Jan. 30, 1986, 2 pages.
English-language translation of Shu et al., "Effect of Nozzles on Energy Separation Performance of Vortex Tube," Journal of Chemical Industry and Engineering (China), vol. 56, No. 11, Nov. 2005.
English-language abstract for JP 62-196561 (Matsushita Refrigeration).
http://www.vortexair.biz/cooling/spotcoolprod/spotcoolprod.htm, printed Mar. 16, 2009, 3 pages.
http://www.vortexair.biz/cooling/coldairgun/coldairgun.html, printed Mar. 16, 2009, 3 pages.
http://www.universal-vortex.com/home/tabid/73/default.aspx, printed Mar. 16, 2009, 4 pages.
http://www.cficinc.com/index.php?id=42, printed Mar. 16, 2009, 2 pages.
http://www.exair.com/en-US/Primary%20navigation/products/vortex%20tubes%20and%20spot%20cooling/pages/vortex%20tubestubes%20and%20spot%20cooling%20home.aspx, printed Mar. 16, 2009, 2 pages.
http://en.wikipedia.org/wiki/vortex_tube, printed Mar. 16, 2009, 3 pages.

* cited by examiner

REFRIGERATOR

CROSS-REFERENCE TO RELATED APPLICATION

This application claims benefit of U.S. Provisional Application No. 60/644,220 filed Jan. 13, 2005.

BACKGROUND OF THE INVENTION

This invention relates to a refrigerator.

Referring to FIG. 1, the vortex tube device 10 receives a supply of compressed gas through a radial inlet 12 to an annular chamber 14 that surrounds a vortex generator 16. The vortex generator, which may be made of synthetic resin material, has an annular wall 18 that is formed with multiple straight bores 20 lying in a common plane perpendicular to the central axis of the annular wall. Typically, there are 6-12 bores depending on the air volume and pressure. The bore size also depends on air volume and pressure. The goal for a vortex tube is to drop as little air pressure as possible in the chamber, to maximize rotational speed after the chamber. The axes of the bores are tangential to the inner cylindrical wall of the vortex generator. The gas entering the annular chamber 14 at relatively high pressure passes through the bores 20 into the cylindrical vortex chamber 24 bounded by the inner cylindrical surface of the vortex generator. The vortex chamber communicates at one axial end with the interior space of a tube 28 by way of a relatively large circular opening and is limited at its opposite axial end by a wall having a substantially smaller circular opening 30. The tube 28 is partially closed at its opposite end, having apertures 34 adjacent the periphery of the tube and being blocked at the center. The apertures 34 may be provided by passages formed in a throttle valve (not shown) that is threaded into the end of the tube 28. Some gas leaves the vortex chamber 24 by way of the tube 28 and the apertures 34 at the far end of the tube, and some gas is able to escape from the vortex chamber by way of the circular opening 30. Because the gas enters the vortex chamber tangentially at high speed, the flow of gas creates a vortex spinning at a speed of up to about 1,000,000 rpm in the vortex chamber and the path of least resistance for the gas in this vortex is through the larger circular opening. Due to the high velocity of the gas particles entering the vortex chamber 24, the particles pass from the vortex chamber into the tube 28 and travel towards the opposite end of the tube. Some of the gas is able to escape through the apertures 34 and gas that is unable to escape must flow back through the tube 28 and through the vortex generator and leave through the opening 30. Because the gas particles arriving at the far end of the tube have substantial angular momentum, the vortex flow is maintained in the flow back toward the vortex generator and an inner vortex is created within the outer vortex flow from the vortex generator. Because the radius of the inner vortex is much smaller than the radius of the outer vortex, the inner vortex initially rotates at a substantially higher angular velocity than the outer vortex. Ultimately, however, friction between the inner vortex and the outer vortex causes the angular velocity of the inner vortex to decrease so that the two vortices rotate at the same angular velocity and there is no longer a difference in angular velocity. Since the radius of the inner vortex is smaller than the radius of the outer vortex, the linear velocity of a particle in the inner vortex is smaller than the linear velocity of a particle in the outer vortex. Consequently, as the inner vortex is decelerated to the angular velocity of the outer vortex, energy is transferred from the particles of the inner vortex to the particles of the outer vortex and the gas stream that leaves through the apertures 34 is at a higher temperature than the inlet gas and the gas stream that leaves through the opening 30 is at a lower temperature than the inlet gas.

The vortex tube device has found several commercial applications, for example in spot cooling, but is subject to limitation as a refrigerator because only a relatively small proportion of the gas leaves through the opening 30.

The published performance data for one commercially available vortex tube device shows that if inlet air at a temperature of 85° F. and relative humidity 55% is supplied at 120 psig and is discharged to ambient pressure (0 psig), the vortex tube device provides 22 cfm air at 35° F. from the cool outlet and consumes 7,460 watts. It can be shown that the coefficient of performance is 0.14.

SUMMARY OF THE INVENTION

In accordance with a first aspect of the invention there is provided a refrigerator comprising an inlet device for receiving a flow of gas under pressure, the inlet device having a cylindrical interior surface bounding an inlet chamber outwardly, a gas flow generator located coaxially of the inlet device and having a cylindrical exterior surface bounding the inlet chamber inwardly and also having a cylindrical interior surface bounding a gas flow chamber, the gas flow generator being formed with passages providing communication between the inlet chamber and the gas flow chamber, so that gas under pressure in the inlet chamber flows through the passages into the gas flow chamber, an energy transfer tube having first and second opposite ends, the energy transfer tube being connected at its first end to the inlet assembly and having a cylindrical interior space in communication with the gas flow chamber, a throttle valve installed in the energy transfer tube at the second end thereof, the throttle valve including a baffle portion that substantially blocks the cylindrical interior space of the energy transfer tube and being formed with at least one port for allowing gas to escape from the interior space of the energy transfer tube at a location adjacent to the tube, the throttle valve being movable lengthwise of the energy transfer tube for selective adjustment of the effective length of the energy transfer tube, and wherein the passages formed in the gas flow generator each have an inner portion that is inclined at a first acute angle to said inner cylindrical surface, an outer portion that is inclined at a second acute angle to said cylindrical exterior surface, and a curved intermediate portion joining the outer portion and inner portion, and the inner portion of each passage formed in the gas flow generator lies in a plane that is inclined at an angle in the range from 4° to 30° to a plane that is perpendicular to the central axis of the energy transfer tube, and wherein the refrigerator is configured such that an acoustic tone at a frequency in the range between about 1 kHz and about 20 kHz is spontaneously generated in the energy transfer tube when gas at a pressure exceeding about 100 psig is supplied to the inlet chamber.

In accordance with a second aspect of the invention there is provided a method of generating a flow of cool air comprising providing a refrigerator that comprises an inlet device for receiving a flow of gas under pressure, the inlet device having a cylindrical interior surface bounding an inlet chamber outwardly, a gas flow generator located coaxially of the inlet device and having a cylindrical exterior surface bounding the inlet chamber inwardly and also having a cylindrical interior surface bounding a gas flow chamber, the gas flow generator being formed with passages providing communication between the inlet chamber and the gas flow chamber, so that gas under pressure in the inlet chamber flows through the passages into the gas flow chamber, an energy transfer tube having first and second opposite ends, the energy transfer tube being connected at its first end to the inlet assembly and having a cylindrical interior space in communication with the gas flow chamber, a throttle valve installed in the energy transfer tube at the second end thereof, the throttle valve including a baffle portion that substantially blocks the cylindrical interior space of the energy transfer tube and being formed with at least one port for allowing gas to escape from the interior space of the energy transfer tube at a location adjacent to the tube, the throttle valve being movable lengthwise of the energy transfer tube for selective adjustment of the effective length of the energy transfer tube, wherein the passages formed in the gas flow generator each have an inner portion that is inclined at a first acute angle to said inner cylindrical surface, an outer portion that is inclined at a second acute angle to said cylindrical exterior surface, and a curved intermediate portion joining the outer portion and inner portion, and the inner portion of each passage formed in the gas flow generator lies in a plane that is inclined at an angle in the range from 4° to 30° to a plane that is perpendicular to the central axis of the energy transfer tube, and wherein the method comprises supplying compressed gas to the refrigerator at a pressure exceeding about 100 psig to the inlet chamber, the refrigerator being configured such that an acoustic tone at a frequency in the range between about 1 kHz and about 20 kHz is spontaneously generated in the energy transfer tube.

BRIEF DESCRIPTION OF THE DRAWINGS

For a better understanding of the invention, and to show how the same may be carried into effect, reference will now be made, by way of example, to the accompanying drawings, in which.

In the following detailed description, reference is made to air as a feed gas in operation of a refrigerator embodying the invention. However, it will be appreciated that other gases may alternatively be used as feed gas, and that air is referred to only by way of example.

DETAILED DESCRIPTION

Figure 2:
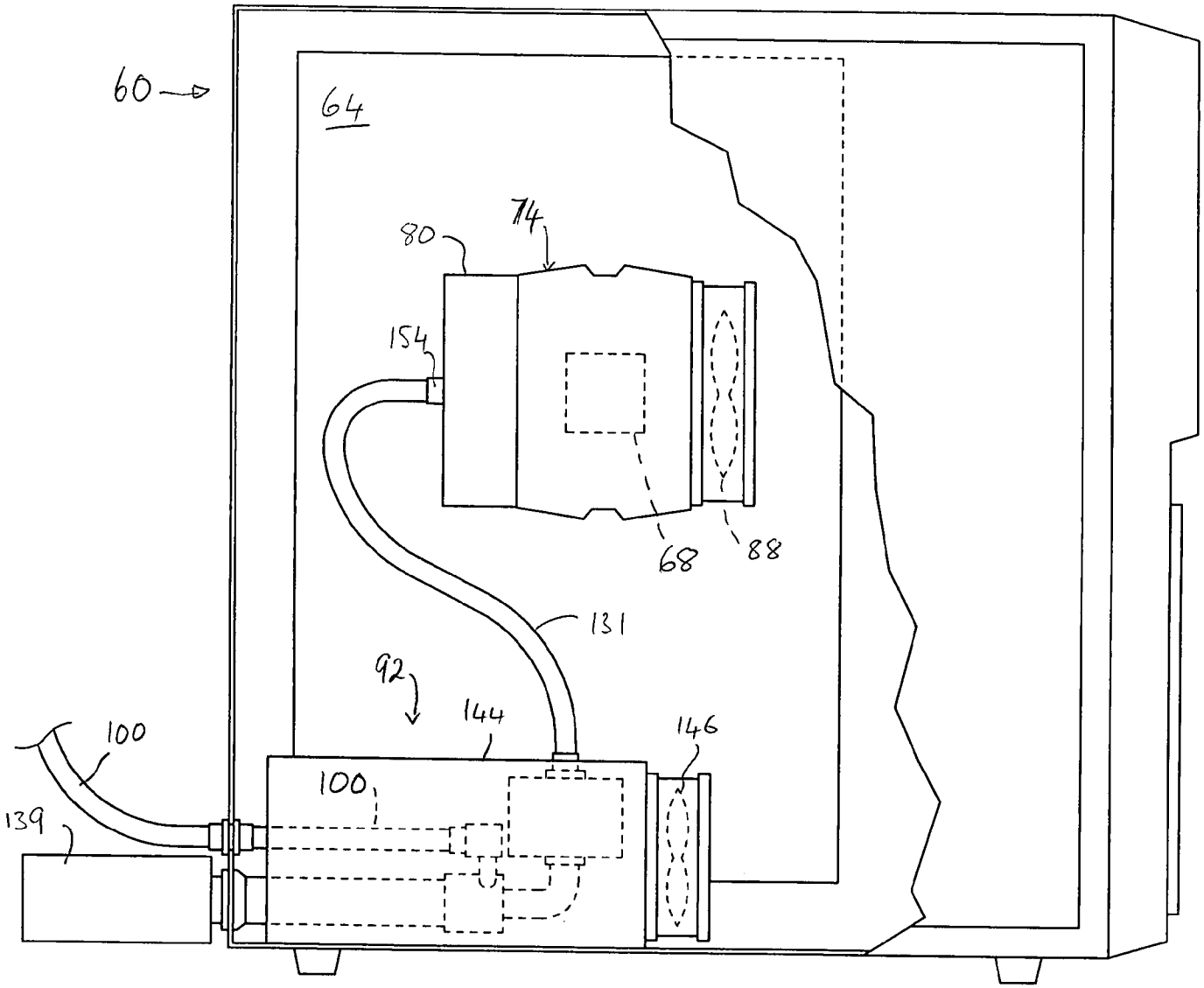
FIG. 2 is a partially broken away side elevation of a computer case equipped with a refrigerator embodying the present invention.
Figure 8:
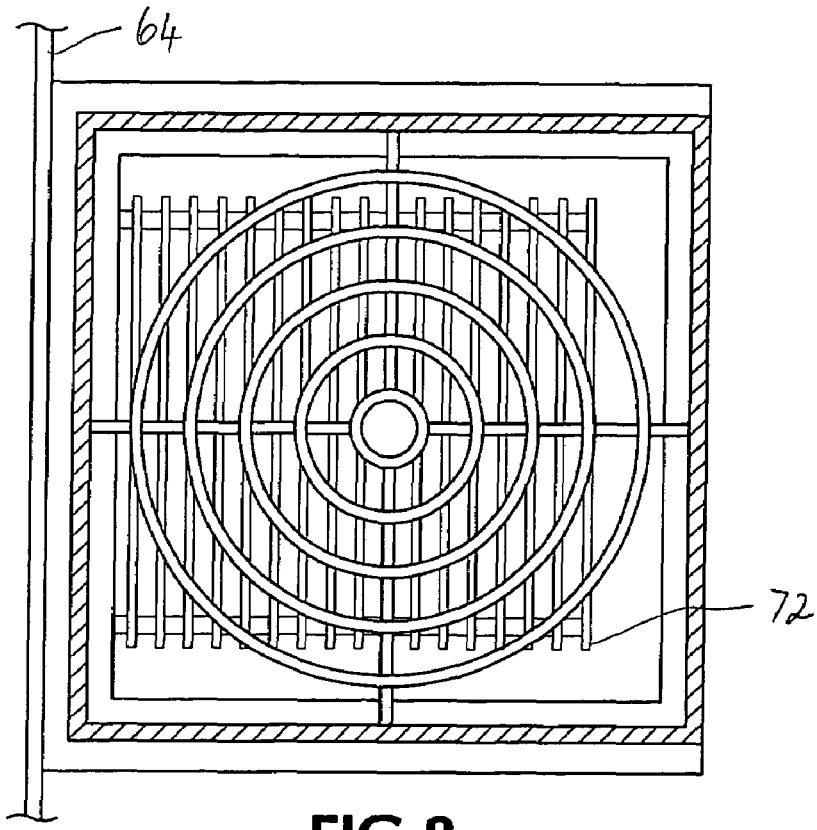
FIG. 8 is a sectional view on the line 8-8 in FIG. 6.

FIG. 2 illustrates a computer case 60 that contains a conventional motherboard 64. A microprocessor 68 is installed in a socket (not shown) that is attached to the motherboard. A heat sink 72 (FIGS. 6 and 8) is in thermally conductive contact with the microprocessor 68.

The computer case is equipped with a refrigerator 92 embodying the present invention. The refrigerator 92 includes a body 96 (FIG. 5) that is connected by tubes 100 to a source of compressed air (not shown). The body 96 defines a cylindrical chamber 104. The passage 106 through which the compressed air enters the chamber 104 is oblique to the radius of the chamber 104 and includes a bore of uniform diameter that flares outwardly into the chamber 104. In a practical embodiment of the invention, the flare is provided by a conical taper and the diameter of the cylindrical chamber 104 is 0.645 inch. The conical taper, which is machined with a 45° burr, is coaxial with the cylindrical portion of the passage.

Figure 6:
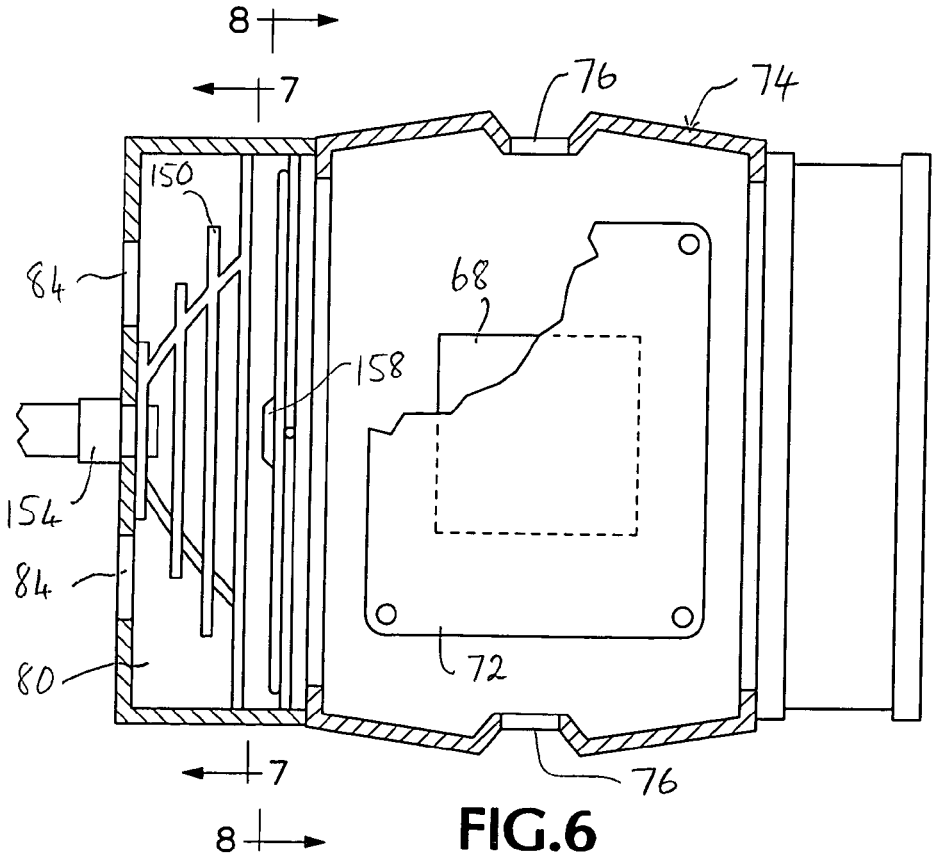
FIG. 6 is a partial sectional view of a cold air diffuser that is mounted in the computer case shown in FIG. 2.
Figure 7:
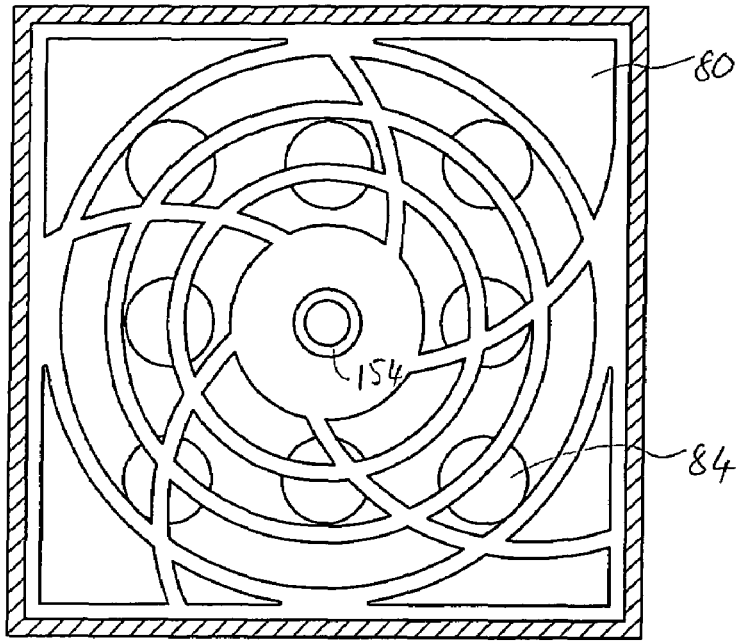
FIG. 7 is a sectional view on the line 7-7 in FIG. 6.

An air flow generator 108 is located in the cylindrical chamber 104. The air flow generator 108 includes an annular portion 109 having an outer surface that is spaced radially from the cylindrical inner surface of the chamber 104 and defines an inner cylindrical chamber 110. The annular portion 109 has an internal flange 113 and an extension tube 111 projects from the flange 113. The annular portion 109 is formed with passages 112 that provide communication between the chambers 104 and 110. The air flow generator 108 is held in position in the body 96 by a molded structure 120 having an external flange 122 that centers the structure 120 in the chamber 104 and an annular boss 124 that fits in the chamber 110. The molded structure 120 includes an extension tube 126 formed with a passage that flares outward from a minimum diameter that is less than the diameter of the extension tube of the air flow generator. The extension tube 126 projects into an outlet tube 128 of the body 96. The outlet tube 128 is connected through a muffler 130 and tube 131 to the inlet chamber 80 of the housing 76 (FIGS. 2, 6 and 7). In the practical embodiment of the invention, the external diameter of the air flow generator is 0.475 inch, and accordingly an annular chamber having a radial extent or depth of 0.085 inch is formed between the external surface of the annular portion 109 of the air flow generator and the internal surface of the body 96. The internal surface of the body 96 is machined with grooves (not shown) having a depth of about 0.002 inch.

An energy transfer tube 132 has an external flange that is located in the chamber 104 and engages the air flow generator 108. The extension tube 111 of the air flow generator fits in the energy transfer tube 132. An isolation tube 134 is threaded into the body 96 and secures the energy transfer tube 132, the air flow generator 108 and the molded structure 120 in the proper positions relative to the body 96. The isolation tube 134 opens to atmosphere through a muffler 139 that is attached to the isolation tube.

At its opposite end, the energy transfer tube 132 is provided with a throttle valve 136 that is in threaded engagement with a fitting attached to the end of the tube 132. The throttle valve 136 is hollow and defines an interior space that communicates with the interior of the energy transfer tube 132 through radial openings 138 and longitudinal grooves 140. The location of the grooves 140 is such that only air close to the wall of the tube 132 can escape from the tube 132 through the throttle valve 136 and hence to atmosphere through the isolation tube 134 and muffler 139.

Figure 5:
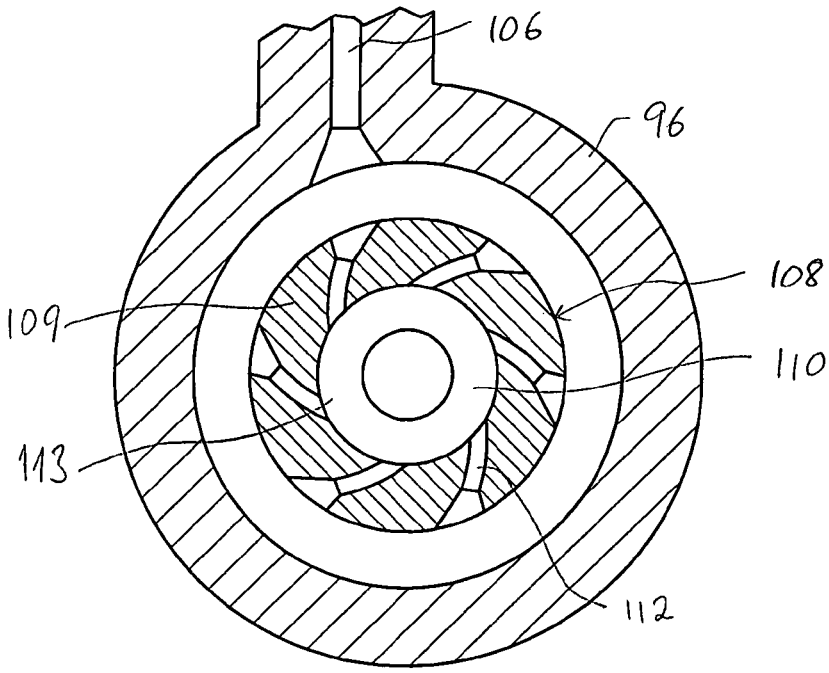
FIG. 5 is a sectional view on the line 8-8 in FIG. 4.

Referring to FIG. 5, it will be seen that the passages 112 in the air flow generator 108 are not straight but are curved so that the central axis of the passage at the inner end is at an angle of about 2-4° to the central axis of the passage at the outer end.

The inlet to the passage 112 is formed using a 30° conical tool that is initially substantially aligned with the radius of the outer peripheral surface of the generator and is then tilted or deflected along the periphery of the air flow generator to extend the inlet. Thus, the downstream (relative to the direction of flow of air in the annular chamber) surface of the inlet is relatively steep, whereas the upstream surface provides a smoother transition from the peripheral surface of the air flow generator to promote flow of air from the annular chamber into the passages 112. Due to the manner in which they are formed, the inlets are elongated about the periphery of the air flow generator, having a length (peripheral dimension) of 0.045 inch and a width (parallel to the central axis of the air flow generator) of 0.030 inch. The passages are of uniform diameter inward of the taper. The angle between the upstream interior surface of the tapered inlet to the passage 112 (relative to the direction of flow of air in the annular chamber) and the outer periphery of the air flow generator, is about 38° +/−2° and the central axis of the passage 112 at its inner end is at about 40° +/−2° to the surface that bounds the chamber 110.

Figure 4:
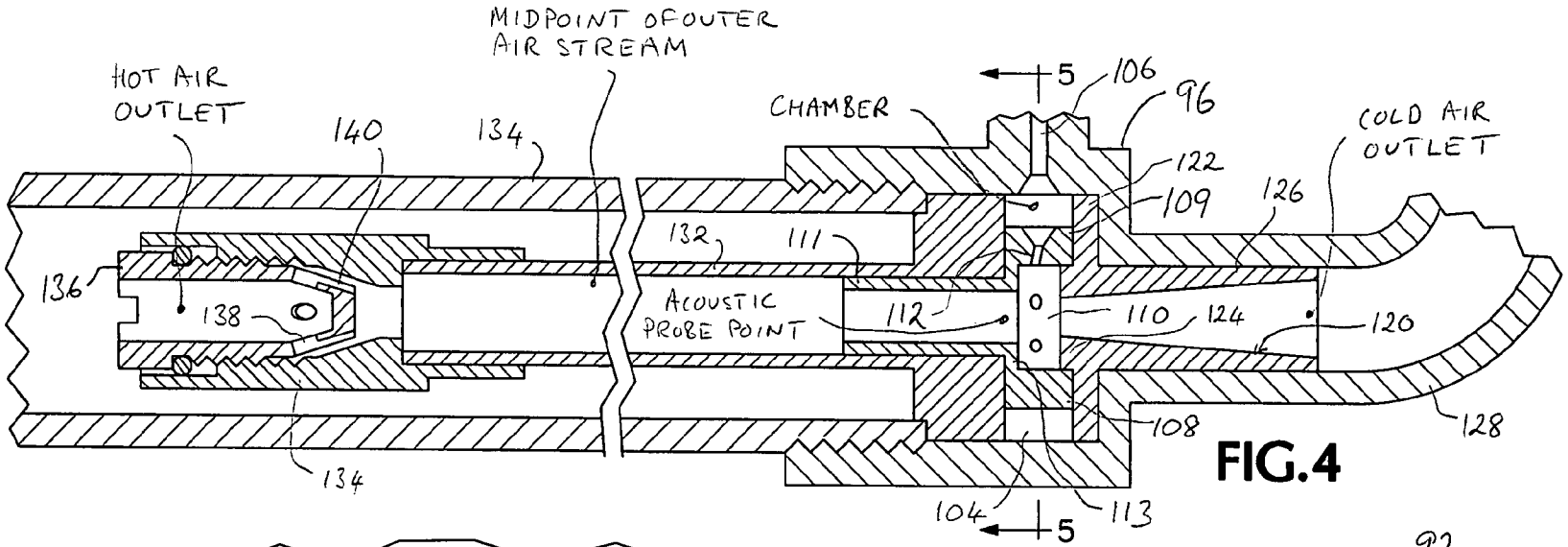
FIG. 4 is a sectional view of an energy transfer tube that forms part of the refrigerator.
Figure 3:
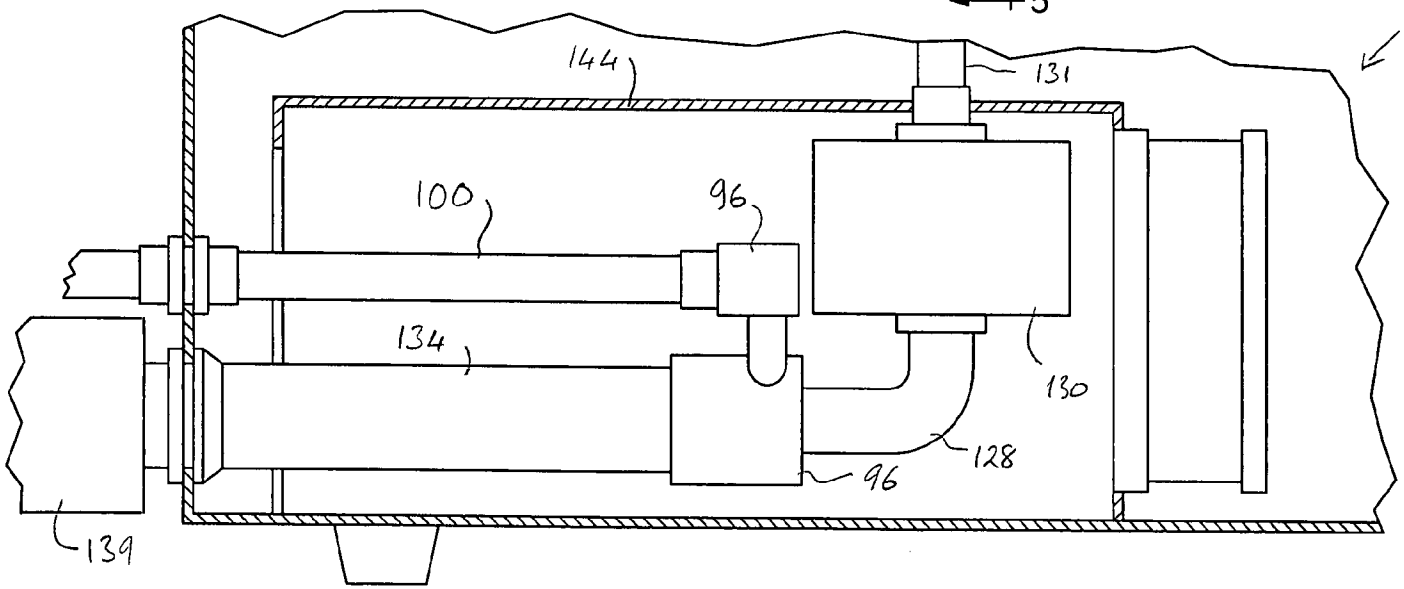
FIG. 3 is an enlarged view, partly in section, of the refrigerator.

Referring to FIG. 4, each passage 112 lies in a plane that is inclined at an angle in the range from 4° to 30°, preferably about 7°, to a plane perpendicular to the central axis of the chamber 110.

The air flow generator is preferably made of a metal alloy and the curved passages 112 are formed by a lost wax process. However, the air flow generator may be made of other materials, such as synthetic resin materials, and by other processes, such as injection molding.

For clarity, FIG. 5 illustrates only six passages 112 but it has been found that the number of passages may typically be from 4 to 8. In the current preferred embodiment of the invention, there are six passages.

The size of the passages 112 has been exaggerated in the drawings for clarity. In the preferred embodiment, the passages are 0.022 inch in diameter. The size of the passages will depend on the desired operating characteristics of the air flow generator. In other prototypes, passages of diameter up to 0.0625 inch have been used.

In operation of the refrigerator, the compressor delivers compressed air at ambient temperature through the tube 100 to the passage 106 and the compressed air enters the chamber 104 and creates a rotating flow in the chamber 104. Since the passage 106 is inclined to the radius of the chamber 104 where the passage debouches into the chamber 104, the air flow in the chamber 104 rotates in the counter clockwise direction as seen in FIG. 5. Air flows from the chamber 104 through the passages 112 into the chamber 110 and creates a revolving outer flow that passes through the extension tube 111 and the energy transfer tube 132. Some of the air of the outer flow escapes through the grooves 140 and passages 138 of the throttle valve 136 and flows to atmosphere through the muffler 139, but a relatively large proportion of the air returns through the tube 132 in a revolving inner flow and leaves through the extension tube 126 and the outlet tube 128. The air flow that leaves the energy transfer tube through the outlet tube 128 is colder than the feed air supplied to the refrigerator by the compressor and the air flow that leaves through the isolation tube 134 and the muffler 139 is hotter than the feed air.

The refrigerator includes a housing 144 provided with a fan 146 that creates a flow of air through the housing. Since the exterior surface temperature of the muffler 130 in the current preferred embodiment is typically about −15° F., the air flow supplied by the fan to the interior of the computer case serves to cool substantially the interior of the computer case. In addition, the air flow through the housing 144 cools the exterior surface of the isolation tube and thereby cools the energy transfer tube.

Referring to FIGS. 2, 6 and 7, the heat sink 72 is mounted in a housing 74 having an inlet chamber 80. The cold air supplied through the tube 131 is discharged into the inlet chamber through a nozzle 154. It is important to prevent the cold air discharged from the nozzle 154 from passing as a narrow, high speed stream through the housing 74, since this could result in very large temperature gradients in the heat sink. The inlet chamber 80 has ambient air inlet openings 84 and the housing 74 is provided with an exhaust fan 88 that conveys a much greater volume of air (at ambient atmospheric pressure) than the volume of cold air supplied by the nozzle 154 (expanded to ambient pressure). Consequently, a large volume of ambient air is induced into the chamber 80 through the inlet openings 84. The chamber 80 contains a ribbed structure 150 against which the ambient air entering the chamber 80 through the inlet opening 84 impinges and the flow of ambient air entering the chamber 80 is thereby diffused over the entire cross sectional area of the inlet chamber. Further, the nozzle 154 directs the cold air provided by the refrigerator 92 through the tube 131 onto a disk or button 158 mounted on a metal spider 162. The button 158 has a dished recess in the surface facing the nozzle 154. When the cold air stream from the nozzle strikes the button, the cold air stream is blocked and the curvature of the recess partially reverses the flow of the cold air, with the result that the cold air stream mixes with ambient air in the chamber 80. The resulting tempered air is drawn by the fan to flow in convective heat exchange relationship with the heat sink 72 and is thereby warmed. Because of the mixing that takes place in the chamber 80, the air flow that impinges on the heat sink is of substantially uniform temperature. In addition, ambient air enters the housing 74 through air inlet slots 76 in the sides of the housing and mixes with the air that enters the housing 74 by way of the chamber 80. The thorough mixing of ambient air with the cool air supplied by the nozzle 154 provides an air stream that creates an even rate of heat transfer from the heat sink and provides a favorable rate of heat transfer from the CPU to the heat sink.

The fan 88 expels the warm air into the computer case from which it is discharged by a conventional fan (not shown).

The button 158 must be made of a material that can withstand repeated cycling through temperatures ranging from −260° F. to 260° F. It has been found that several ceramic materials are suitable. One suitable mineral material is black opal.

The computer case (with motherboard and processor) serves as a test bench for measuring performance of the refrigerator, since it is possible to determine quite accurately the thermal load presented by the heat sink to the cool air flow provided by the refrigerator.

Figure 1:
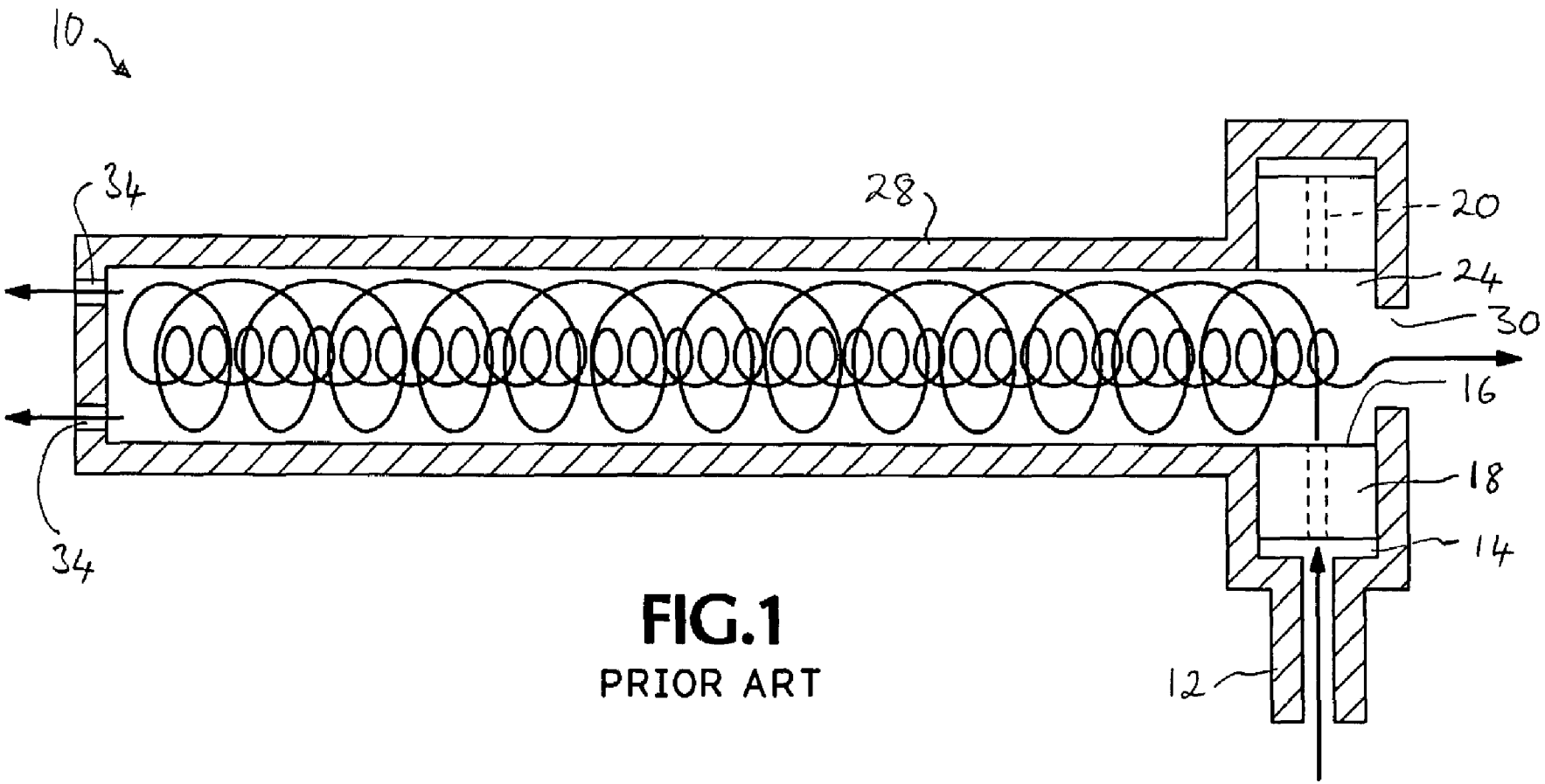
FIG.1 PRIOR ART
FIG. 1 is a sectional view of a conventional vortex tube.

It has been found through extensive experimentation that under most operating conditions the refrigerator described with reference to FIGS. 2-5 has far superior performance relative to the vortex tube device shown in FIG. 1. For example, when compressed air at 85° F. and 55% relative humidity is supplied at 110 psig and is discharged to ambient pressure at 28.9 in. Hg. and the throttle valve 136 is set so that the outlet flow through the throttle valve is approximately 0.3 cfm, the flow supplied to the heat sink is 40 cfm at ambient pressure and at a temperature of 34° F., and the power consumption of the compressor is only 750 w. In this case, the coefficient of performance is 2.53. The temperature at which the cool air is supplied to the heat sink will of course depend on ambient temperature. The temperature of the cool air flow also depends on the temperature of the air flow provided by the nozzle 154.

The achievement of superior performance has been traced to the presence of an acoustic vibration in the vicinity of the opening from the passages 112 into the chamber 110. It has also been found that performance is better if the acoustic vibration exists over substantially the entire length of the heat transfer tube than if the acoustic tone exists only at the opening of the passages 112 into chamber 110. The existence of the acoustic vibration in the chamber 110 and in the heat transfer tube has been verified by inserting a probe into the tube through the cool air outlet.

In the practical implementation described above, an acoustic tone at a frequency of 2.177 kHz is generated using compressed air supplied at a flow rate of 4.2 cfm at pressure of 110 psig. The grooves in the internal surface of the body 96 direct the air flow into the passages 112 but do not affect significantly the frequency of the acoustic tone.

Variables that affect whether an acoustic vibration is generated in the heat transfer tube include the radial extent of the annular canal, the orientation of the air inlet passage 106 relative to the passages 112 in the air flow generator, the depth and angle of the taper with which the passage 106 opens into the chamber 104, the depth and angle of taper of the passages 112, the number, size, length and orientation of passages 112, the angular difference between the inlet of the passage 112 and the outlet of the passage 112, the internal and external diameters of the air flow generators, and the angle (typically 7° ) between the passage 112 and a plane perpendicular to the central axis of the air flow generator.

Several experiments were conducted using the same air flow generator with annular chambers of different volume. The volume of the annular chamber was modified by forming an annular canal or channel in the interior of the body 96. Thus, after drilling out the interior of the body to the external diameter of the flange 122 (0.555 inch in the preferred embodiment), the annular canal was machined in the interior surface of the body 96 so that it would be located between the flange 122 and the external flange of the energy transfer tube. Machining the canal created the peripheral grooves at the external surface of the annular chamber. The various experiments were characterized by the ratio of the diameter D of the air flow generator to the depth R of the canal could be varied. In each case, the air pressure at five points along the air path was measured. The results of ten of these experiments are reported in the following Table A and Table B, in which the columns designated 1-10 contain the observations for the ten experiments respectively.

TABLE A

| | 1 | 2 | 3 | 4 | 5 |
|---|---|---|---|---|---|
| Ratio | 10.555 | 8.636 | 7.307 | 13.571 | 15.833 |
| Supply Pressure | 120 | 120 | 120 | 120 | 120 |
| Chamber | 101 | 99 | 97 | 104 | 107 |
| Midpoint of Outer Stream | 40 | 39 | 38 | 43 | 44 |
| Hot Air Outlet | 20 | 18 | 18 | 20 | 20 |
| Cool Air Outlet | 20 | 18 | 18 | 20 | 20 |
| Frequency (kHz) | 2.177 | 1.857 | 1.682 | 2.780 | 3.540 |
| Entire Length? | Y | N | Y | N | N |
| Cool Air Flow? | Y | Y | Y | Y | Y |

TABLE B

| | 6 | 7 | 8 | 9 | 10 |
|---|---|---|---|---|---|
| Ratio | 23.75 | 11.875 | 9.500 | 6.785 | 14.843 |
| Supply Pressure | 120 | 120 | 120 | 120 | 120 |
| Chamber | 115 | 103 | 99 | 90 | 105 |
| Midpoint of Outer Stream | 60 | 47 | 42 | 35 | 43.5 |
| Hot Air Outlet | 20 | 20 | 18 | 16 | 18 |
| Cool Air Outlet | 20 | 20 | 17 | 16 | 17 |
| Frequency (kHz) | None | None | 1.985 | None | 3.25 |
| Entire Length? | N/A | N/A | Y | N/A | Y |
| Cool Air Flow? | Small | Small | Y | Small | Y |

In each table, the row Ratio reports, for each experiment, the ratio of the diameter D of the air flow generator to the depth R of the canal. The next row reports the supply pressure (in psig) and the next four rows report the pressure (in psig) at four points along the air flow path, as shown in FIG. 4. The row designated Frequency reports the frequency of the acoustic tone that was observed in the energy transfer tube at the acoustic probe point marked in FIG. 4 by a probe inserted through the cool air outlet and placed on the axis of the tube. The row Entire length? Reports whether the tone was sensed over the entire length of the energy transfer tube. Whether the tone was sensed over the entire length was determined based on observations made with the probe inserted to a point about halfway along the energy transfer tube and with the probe inserted almost as far as the throttle valve. The row Cool air flow reports whether a cool air flow was detected at the cool air outlet. The temperature of the cool air flow was substantially lower when the tone existed along the entire length of the energy transfer tube.

Pressures were measured using a static pressure probe sold by OTC. Frequency measurements were made using an Extech Model 407790 Octave Band Sound Analyzer (Type 2 meter) and a Norsonic Model 110 real time sound meter.

Experiments also showed that if the refrigerator was operating in accordance with the conditions defined for Experiment 1, 3, 8 or 10 and the acoustic vibration was suppressed, e.g. by coupling a vibration at a significantly different frequency to the interior of the energy transfer tube, the temperature of the air leaving the cool air outlet increased virtually immediately almost to the inlet air temperature. The housing 144 and the isolation tube 134 serve to isolate the energy transfer tube 132 from acoustic vibrations that might be created within the computer case, e.g. by disk drive motors, and that might otherwise be coupled to the energy transfer tube and suppress the acoustic vibrations in the tube and thereby degrade the performance of the refrigerator.

The acoustic vibration is generated spontaneously in the energy transfer tube due to energy of disturbances in the air flow being preferentially amplified in a range of frequencies that is characteristic of the gas flow rate and the physical structure of the energy transfer tube. By adjusting the throttle valve, the energy transfer tube is tuned to a narrow range of frequencies within a broader range.

It will be seen from Experiments 6, 7 and 9 that even though no acoustic tone was observed, heat transfer between the inner air stream and the outer air stream due to loss of angular velocity of the inner air stream produced a small flow of cool air.

The features of the refrigerator that favor generation of the acoustic vibration include the configuration of the passages 112 and the orientation of the passages 112 relative to the central axis of the air flow generator. Other features that favor the generation of the acoustic vibration include the relatively large radial extent of the annular chamber 104 and the orientation of the inlet passage 106 to the chamber 104. Thus, in the case of the vortex tube device, it is considered sufficient to configure the vortex generator so that the air flow into the vortex chamber is tangential to the vortex chamber, without regard to flow conditions upstream of the air flow generator. In the case of the refrigerator illustrated in the drawings, the transition of the flow from the air flow generator to the energy transfer tube 132 is less abrupt than in the case of the vortex tube device and the inlet to the chamber 104 and the configuration of the chamber 104 itself (having a relatively large radial extent) are selected to minimize disturbance of the outer air flow in the energy transfer tube.

The throttle valve, in addition to serving to tune the energy transfer tube, contributes to the favorable performance of the energy transfer tube by ensuring that the hottest fraction of the outer stream or flow is removed and cannot mix with cooler air of the inner flow.

It is important to note that the refrigerator described with reference to FIGS. 2-8 does not operate on the same principle as the vortex tube device described with reference to FIG. 1. This is evident from the superior performance and the fact that the air flow in the chamber spins at a substantially lower speed than the vortex flow in the vortex chamber of the vortex tube device (less than 750,000 rpm versus about 1,000,000 rpm). Further, experiments conducted with a conventional vortex tube device, operating in a manner such as to produce a flow of cool air, revealed no acoustic vibration, as reported above for experiments 1-5.

It will be appreciated that the invention is not restricted to the particular embodiment that has been described, and that variations may be made therein without departing from the scope of the invention as defined in the appended claims and equivalents thereof. For example, although the experiments reported in the table show frequencies of the acoustic tone in the range from about 1.5 kHz to about 4 kHz, in other embodiments of the invention frequencies as low as 1 kHz and as high as 20 kHz have been observed. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

The invention claimed is:

1. A refrigerator comprising: an inlet device for receiving a flow of gas under pressure, the inlet device having a cylindrical interior surface bounding an inlet chamber outwardly, a gas flow generator having a cylindrical exterior surface bounding the inlet chamber inwardly and also having a cylindrical interior surface bounding a gas flow chamber, the gas flow generator having inclined passages that provide communication between the inlet chamber and the gas flow chamber, so that gas under pressure in the inlet chamber flows through the passages and into the gas flow chamber, an energy transfer tube having first and second ends and having a cylindrical interior space in communication with the gas flow chamber, the second end of the energy transfer tube having a least one port at a location adjacent to the tube for allowing gas to escape from inside the energy transfer tube, wherein an inner portion of each passage of the generator lies in a plane inclined at an angle in the range of 4 degrees to 30 degrees to a plane perpendicular to a central axis of the energy transfer tube, wherein each passage is not straight but rather is curved, the refrigerator being configured such that an acoustic tone is spontaneously generated in the energy transfer tube when gas at a pressure exceeding about 100 psig is supplied to the inlet chamber.

2. The refrigerator of claim 1 wherein the acoustic tone is generated adjacent to openings from the passages into the gas flow chamber.

3. The refrigerator of claim 1 wherein the acoustic tone is generated over substantially the entire length of the energy transfer tube.

4. The refrigerator of claim 1 wherein the acoustic tone has a frequency in the range of between about 1 kHz and about 1 kHz

5. The refrigerator of claim 1 wherein the acoustic tone has a frequency in the range of between about 1.5 kHz and about 4 kHz

6. The refrigerator of claim 1 wherein the inlet device has an inlet passage through which the flow of gas under pressure is delivered to reach the inlet chamber, the inlet chamber having a radius, wherein the inlet passage is oblique to the radius of the inlet chamber.

7. The refrigerator of claim 1 further comprising an acoustic dampener tube through which the energy transfer tube extends.

8. The refrigerator of claim 1 wherein the gas flow generator has between four and eight passages that provide communication between the inlet chamber and the gas flow chamber.

9. The refrigerator of claim 1 wherein a central axis of each passage at an inner end is at an angle of about 2-4 degrees to a central axis of the passage at an outer end.

10. The refrigerator of claim 1 wherein the second end of the energy transfer tube is provided with a throttle valve.

11. The refrigerator of claim 1 wherein each passage of the generator has a diameter of 0.0625 inch or less.

12. The refrigerator of claim 1 wherein the refrigerator is configured such that compressed gas flowing through the inlet device and into the inlet chamber passes through the passages in the generator and into the gas flow chamber, which causes a revolving outer flow to pass through the energy transfer tube toward the second end of the tube, wherein some of this revolving flow escapes from the tube through said port but a major portion returns through the tube in a revolving inner flow that moves toward the first end of the tube and escapes through an outlet.

13. A refrigerator comprising: an inlet device for receiving a flow of gas under pressure, the inlet device having a cylindrical interior surface bounding an inlet chamber outwardly, a gas flow generator having a cylindrical exterior surface bounding the inlet chamber inwardly and also having a cylindrical interior surface bounding a gas flow chamber, the gas flow generator having inclined passages that provide communication between the inlet chamber and the gas flow chamber, so that gas under pressure in the inlet chamber flows through the passages into the gas flow chamber, wherein an inner portion of each passage of the generator lies in a plane inclined at an angle in the range of 4 degrees to 30 degrees to a plane perpendicular to a central axis of the energy transfer tube, wherein each passage is not straight but rather is curved, an energy transfer tube having a length extending between first and second ends and having a cylindrical interior space in communication with the gas flow chamber, the second end of the energy transfer tube having a least one port at a location adjacent to the tube for allowing gas to escape from inside the energy transfer tube, wherein compressed gas flowing through the inlet device and into the inlet chamber passes through the passages of the generator and into the gas flow chamber, which causes a revolving outer flow to pass through the energy transfer tube toward the second end of the tube, wherein some of this revolving flow escapes from the tube through said port but a major portion returns through the tube in a revolving inner flow that moves toward the first end of the tube and escapes through an outlet, the refrigerator being configured to generate an acoustic tone over substantially the entire length of the energy transfer tube when gas at a supply pressure exceeding about 100 psig is supplied to the inlet device.

14. The refrigerator of claim 13 wherein the inlet device has an inlet passage through which the flow of gas under pressure is delivered to reach the inlet chamber, the inlet chamber having a radius, wherein the inlet passage is oblique to the radius of the inlet chamber.

15. A method of generating a flow of cool air, the method comprising:

providing a refrigerator that includes an inlet device for receiving a flow of gas under pressure, the inlet device having a cylindrical interior surface bounding an inlet chamber outwardly, a gas flow generator having a cylindrical exterior surface bounding the inlet chamber inwardly and also having a cylindrical interior surface bounding a gas flow chamber, the gas flow generator having inclined passages that provide communication between the inlet chamber and the gas flow chamber, so that gas under pressure in the inlet chamber flows through the passages into the gas flow chamber, wherein an inner portion of each passage of the generator lies in a plane inclined at an angle in the range of 4 degrees to 30 degrees to a plane perpendicular to a central axis of the energy transfer tube, wherein each passage is not straight but rather is curved, an energy transfer tube having a length extending between first and second ends and having a cylindrical interior space in communication with the gas flow chamber, the second end of the energy transfer tube having a least one port at a location adjacent to the tube for allowing gas to escape from inside the energy transfer tube; and flowing compressed gas through the inlet device, into the inlet chamber, through the inclined passages of the generator and into the gas flow chamber, thereby causing a revolving outer flow to pass through the energy transfer tube toward the second end of the tube, wherein some of this revolving flow escapes from the tube through said port but a major portion returns through the tube in a revolving inner flow that moves toward the first end of the tube and escapes through an outlet tube at the first end of the energy transfer tube, wherein an acoustic tone is generated in the energy transfer tube.

16. The method of claim 15 wherein the inlet device has an inlet passage through which the flow of gas under pressure is delivered to reach the inlet chamber, the inlet chamber having a radius, wherein the inlet passage is oblique to the radius of the inlet chamber.

17. The method of claim 15 wherein the acoustic tone is generated over substantially the entire length of the energy transfer tube.

18. The method of claim 15 wherein the acoustic tone has a frequency in the range of between about 1 kHz and about 12 kHz.

19. The method of claim 15 wherein said revolving flows spin at less than 750,000 rotations per minute.

20. A refrigerator comprising: an inlet device for receiving a flow of gas under pressure, the inlet device having a cylindrical interior surface bounding an inlet chamber outwardly, a gas flow generator located coaxially of the inlet device and having a cylindrical exterior surface bounding the inlet chamber inwardly and also having a cylindrical interior surface bounding a gas flow chamber, the gas flow generator being formed with passages providing communication between the inlet chamber and the gas flow chamber, so that gas under pressure in the inlet chamber flows through the passages into the gas flow chamber, an energy transfer tube having first and second opposite ends, the energy transfer tube being connected at its first end to the inlet assembly and having a cylindrical interior space in communication with the gas flow chamber, a throttle valve installed in the energy transfer tube at the second end thereof, the throttle valve including a baffle portion that substantially blocks the cylindrical interior space of the energy transfer tube and being formed with at least one port for allowing gas to escape from the interior space of the energy transfer tube at a location adjacent to the tube, the throttle valve being movable lengthwise of the energy transfer tube for selective adjustment of the effective length of the energy transfer tube, and wherein the passages formed in the gas flow generator each have an inner portion that is inclined at a first acute angle to said inner cylindrical surface, an outer portion that is inclined at a second acute angle to said cylindrical exterior surface, and a curved intermediate portion joining the outer portion and inner portion, and the inner portion of each passage formed in the gas flow generator lies in a plane that is inclined at an angle in the range from 4 degrees to 30 degrees to a plane that is perpendicular to the central axis of the energy transfer tube, and wherein the refrigerator is configured such that an acoustic tone at a frequency in the range between about 1 kHz and about 20 kHz is spontaneously generated in the energy transfer tube when gas at a pressure exceeding about 100 psig is supplied to the inlet chamber.

21. The refrigerator of claim 20 wherein the refrigerator is configured such that the acoustic tone is spontaneously generated in the energy transfer tube over substantially the entire length of the energy transfer tube.

22. The refrigerator of claim 20 wherein the second acute angle is in the range from 20 degrees to 50 degrees.

23. The refrigerator of claim 22 wherein the second acute angle is in the range from 38 degrees to 42 degrees.

24. The refrigerator of claim 20 wherein the frequency is in the range from about 1 kHz to about 4 kHz.

25. A method of generating a flow of cool air comprising: providing a refrigerator that comprises an inlet device for receiving a flow of gas under pressure, the inlet device having a cylindrical interior surface bounding an inlet chamber outwardly, a gas flow generator located coaxially of the inlet device and having a cylindrical exterior surface bounding the inlet chamber inwardly and also having a cylindrical interior surface bounding a gas flow chamber, the gas flow generator being formed with passages providing communication between the inlet chamber and the gas flow chamber, so that gas under pressure in the inlet chamber flows through the passages into the gas flow chamber, an energy transfer tube having first and second opposite ends, the energy transfer tube being connected at its first end to the inlet assembly and having a cylindrical interior space in communication with the gas flow chamber, a throttle valve installed in the energy transfer tube at the second end thereof, the throttle valve including a baffle portion that substantially blocks the cylindrical interior space of the energy transfer tube and being formed with at least one port for allowing gas to escape from the interior space of the energy transfer tube at a location adjacent to the tube, the throttle valve being movable lengthwise of the energy transfer tube for selective adjustment of the effective length of the energy transfer tube, wherein the passages formed in the gas flow generator each have an inner portion that is inclined at a first acute angle to said inner cylindrical surface, an outer portion that is inclined at a second acute angle to said cylindrical exterior surface, and a curved intermediate portion joining the outer portion and inner portion, and the inner portion of each passage formed in the gas flow generator lies in a plane that is inclined at an angle in the range from 4 degrees to 30 degrees to a plane that is perpendicular to the central axis of the energy transfer tube, and wherein the method comprises supplying compressed gas to the refrigerator at a pressure exceeding about 100 psig to the inlet chamber, the refrigerator being configured such that an acoustic tone at a frequency in the range between about 1 kHz and about 20 kHz is spontaneously generated in the energy transfer tube.

26. The refrigerator of claim 1 wherein each passage has an inlet that is elongated about a periphery of the generator so as to have a taper at the inlet, and wherein each passage is of uniform diameter inward of the taper.

27. The refrigerator of claim 13 wherein each passage has an inlet that is elongated about a periphery of the generator so as to have a taper at the inlet, and wherein each passage is of uniform diameter inward of the taper.

28. The method of claim 15 wherein each passage has an inlet that is elongated about a periphery of the generator so as to have a taper at the inlet, and wherein each passage is of uniform diameter inward of the taper.

29. The refrigerator of claim 20 wherein each passage has an inlet that is elongated about a periphery of the generator so as to have a taper at the inlet, and wherein each passage is of uniform diameter inward of the taper.

30. The method of claim 25 wherein each passage has an inlet that is elongated about a periphery of the generator so as to have a taper at the inlet, and wherein each passage is of uniform diameter inward of the taper.

* * * * *